US005402743A

United States Patent [19]

Holderman

[11] Patent Number: 5,402,743

[45] Date of Patent: Apr. 4, 1995

[54] DEEP CHINE HULL DESIGN

[76] Inventor: Jim D. Holderman, 4044 Estrella St., San Diego, Calif. 92105

[21] Appl. No.: 170,521

[22] Filed: Dec. 20, 1993

Related U.S. Application Data

[63] Continuation-in-part of Ser. No. 954,552, Sep. 30, 1992, abandoned, which is a continuation-in-part of Ser. No. 732,942, Jul. 19, 1991, abandoned, which is a continuation-in-part of Ser. No. 503,273, Apr. 3, 1990, abandoned, which is a continuation-in-part of Ser. No. 202,808, Jun. 6, 1988, abandoned.

[51] Int. Cl.[6] ..... B63B 1/16

[52] U.S. Cl. ..... 114/62; 114/290; 441/74

[58] Field of Search ..... 114/56, 62, 288, 290, 114/61; 441/74

[56] References Cited

U.S. PATENT DOCUMENTS

| | | | |
|---|---|---|---|
| 1,658,080 | 2/1928 | Ferron | 114/290 |
| 2,020,792 | 11/1935 | Maynard et al. | 114/290 |
| 2,546,704 | 3/1951 | Sweeny et al. | 114/62 |
| 3,108,561 | 10/1963 | McNeil et al. | 114/290 |
| 4,091,761 | 5/1978 | Fehn | 114/290 |
| 4,445,453 | 5/1984 | Morgan, Jr. | 114/290 |

FOREIGN PATENT DOCUMENTS

| | | | |
|---|---|---|---|
| 0058029 | 8/1891 | Germany | 114/62 |

*Primary Examiner*—Sherman Basinger

[57] ABSTRACT

There is disclosed an inverted bottom structure having generally convex, longitudinal buttock and waterlines lines which creates a venturi structure and a variable pressure/suction situation along the boat hull bottom. The under sides of the boat hull are highly concave resulting in the varying speed of flow which limits the throw-out of water wake while the inverted bottom of the boat hull eliminates turbulent, drag flow. The depth of the longitudinal bottom channels progressively deepens, thereby encompassing a growing volume of smooth water flowing aft in the channels which creates inertia lateral resistance while causing minimal increase in resistance to forward movement. The finely contoured, longitudinal, horizontal and cross sectional lines create a controlled flow situation whereby uncontrolled turbulent flow is replaced with controlled laminar flow, introducing an unprecedented reduction in resistance, to forward movement per displacement, and a profound increase in lateral resistance.

63 Claims, 9 Drawing Sheets

FIG. 5
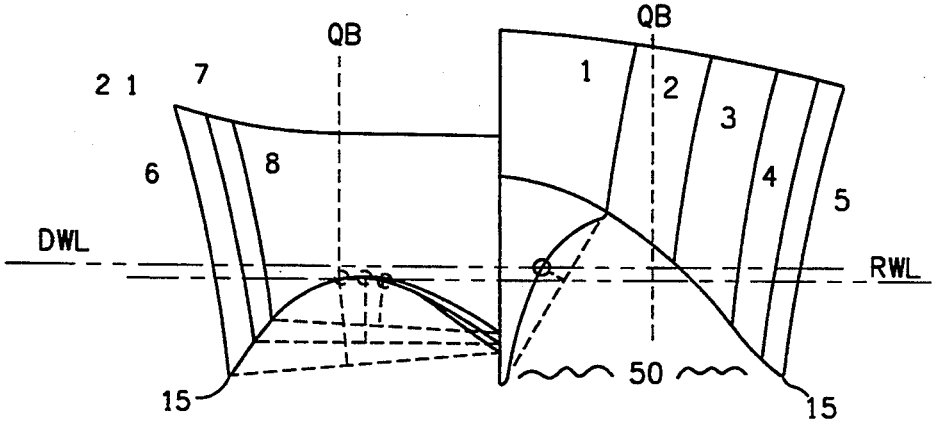
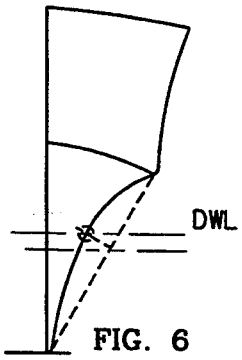
FIG. 6
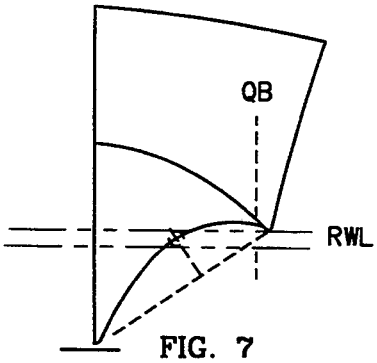
FIG. 7
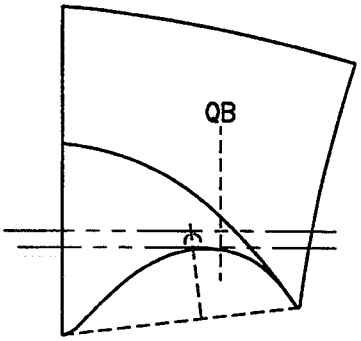
FIG. 8
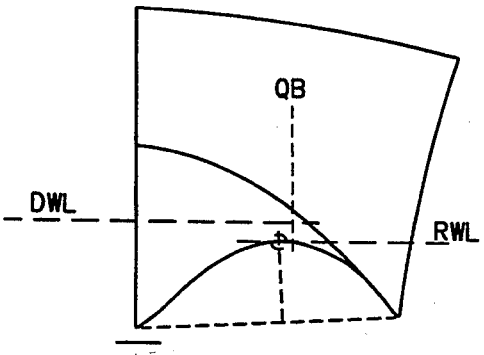
FIG. 9
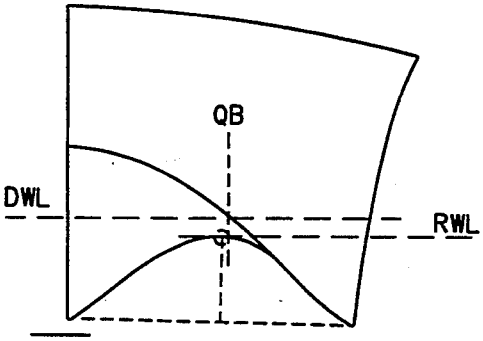
FIG. 10

FIG. 11
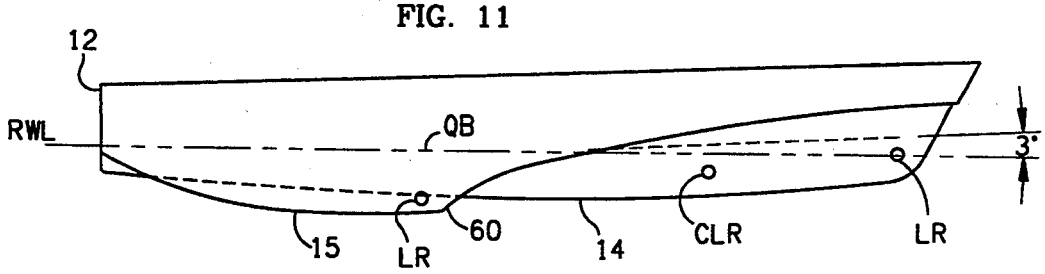
FIG. 12
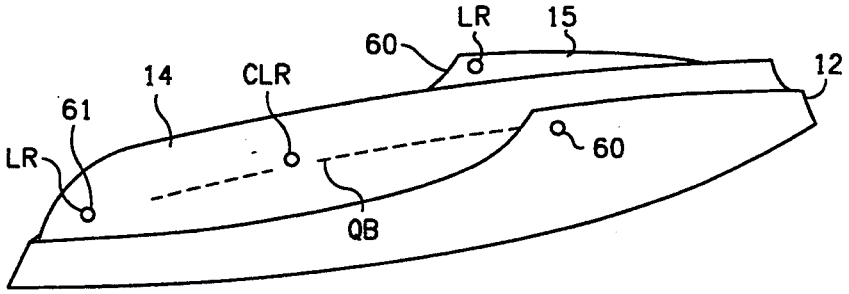
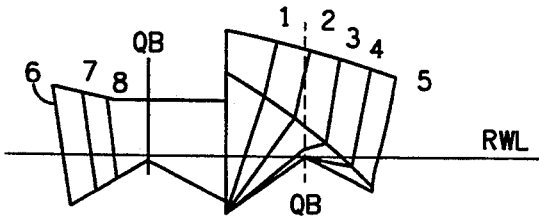
FIG. 13
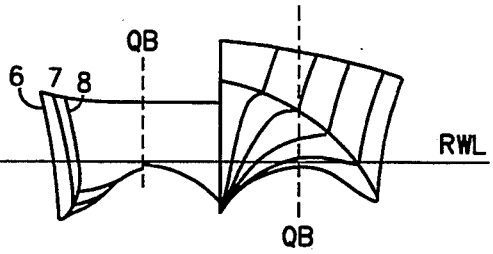
FIG. 14

DEEP CHINE HULL DESIGN

RELATED APPLICATIONS

This application is a Continuation-in-Part of Ser. No. 07/954,552, filed Sep. 30, 1992, now abandoned which application in turn is a Continuation In Part of Ser. No. 07/732,942, filed Jul. 19, 1991, now abandoned, which application in turn is a Continuation-in-Part of Ser. No. 07/503,273, filed Apr. 03, 1990, now abandoned which in turn is a Continuation-in-Part of Ser. No. 07/202,808, filed Jun. 06, 1988, now abandoned. The disclosures of my prior U.S. patent applications Ser. Nos. 202,808 (1st) filed Jun. 6, 1988), 503,273 (filed Apr. 3, 1990) 07/732,942 (Jul. 19, 1991) 07/954,552 (filed Sep. 30, 1992), all now abandoned, are hereby incorporated herein by reference.

BACKGROUND OF THE INVENTION

1. Field of the Invention

This invention relates to boat hulls, and more particularly, to mono-hull, channel bottom boats having curved sides and finely, contoured channels extending along both sides of the keel. The channels have a venturi structure defined continually along their length. The fore sections have roll-under planes that deflect water flow, completely under the channels and into the venturi structure, during passage, thereby introducing extended laminar flow and a Controlled Flow Feature. The bow sections have finer entry angles which substantially reduce "wave-making" boat hull resistance.

The boat hull design also introduces a pair of deeply rockered, or deeply descending chines, extending laterally and aftwardly from the upper part of the bow which may descend downward below the bottom of the keel. The deepness of the chines harbor a large volume of relative still water, (in respect to lateral movement) trapped within the channels, which the boat cannot climb over, and which accomplish pronounced lateral resistance, by having inherent static inertia compounded by venturi flow aftward to the direction of forward movement.

The rolling-under by the bow and chine planes absorb much of the shock of the head waves rendering it possible to incorporate relative flat buttock lines along the length of the channels, which have low resistance to forward movement.

A Controlled Flow Principle is hereby introduced to boat hull design.

This invention applies to all marine designs, from surf boards to deep-displacement merchant boats, or whatever, all having a reduction in resistance per displacement and improved sea going qualities.

2. Related Art

The total resistance of a boat can be placed into two parts; "Skin friction" resistance S/F (viscosity drag), and Form Resistance; sometimes called "wave-making" resistance W/M. "Skin friction" and "wave making" resistance we see as wake and it represents the water dragged along by the boat hull.

"Skin friction" S/F accounts for the greater part of resistance at slow, below planing speeds whereas "wave-making" W/M resistance accounts for the greater part of resistance at faster, above planing speeds; in all conventional boats.

Resistance of a boat hull may be either laminar flow in character, resulting from finely contoured or concave flow lines; or turbulent flow in character caused by convex flow lines.

Concave lines tend to "hug" the water because the following impetus to water is always greater than the inertia flow-out caused by the preceding impetus. Laminar flow prevails.

Convex lines force water flow away from the hull because the following impetus is always less then the inertia flow-out caused by the preceding impetus. Separation of flow is inevitable, with eventual cavitation of flow especially in the bow sections which will rewult in "sailing under".

Turbulent flow, for the most part, always prevails with all contemporary boat designs.

Additionally, we have two types of boat hull designs; deep displacement boats which are unable to surmount their head waves but "dig a hole in the water and sail under" when they are driven by wind or power beyond the limitation imposed by their water-line-limit, during passage; and surface planing boats which are able to climb up on their head waves and plane.

The deep displacement boats are limited in speed by roughly 1.5 times the square root of their water-line-length as stated in knots per hour, but are able to carry much more cargo and are more sea-worthy. The planing boats go much faster but, cannot carry as much weight and are subject to hammering and pounding during rough weather.

The Deep Chine inventive hull has flat buttock curves that do not rise up to the deck level; they merely end at the prow and may be held flat. Smooth laminar flow is maintained along the finely contoured bottom channels, buttock curves and converging waterlines. It can be claimed that substantially NO "white water" appears between the chines, during passage.

Contemporary boat designs, on the other hand, seem to rest in the de-controlled flow principle, with convex lines being predominant throughout the hull lines that produce turbulent flow, for the most part, even, with tri-bottom run-a-bouts. Modern boat designs have greater power per displacement but not less resistance per displacement.

Preoccupation with power accommodation seems to be the primary concern with contemporary boat designers, but design for less resistance, let alone extended laminar flow, has eluded boat designers until the appearance of the Deep Chine design.

It is therefore the chief object of this invention to provide an improved boat hull design that will substantially reduce overall water resistance per displacement during all speeds of passage and sailing conditions by introducing the Controlled Flow Principle. (CFP)

A major object is to establish and extend laminar flow along the entire length of the hull bottom and sides by a combination of specially contoured lines which maintain consistent hull pressure against the water passage, thereby ihibiting separation and the formation of turbulent flow.

A necessary objective is the formation of inverted channels having cross sections being either concave or flat, along the longitudinal length of the boat hull on both sides of the keel.

An indispensable further object is to provide a venturi flow effect with converging waterlines defining a venturi structure having a venturi mouth, a venturi throat and a exit area defined along the channels.

A further object is to roll, or deflect the bow and chine headwaves down and completely under the bi-lateral deeply inverted bottom channels creating generally level dual "WATER RAILS" out of the surface of the sea, for the boat to ride on.

An additional object is to position the boat hull on it's "WATER RAILS" where it can ride upon its quarter buttock and not on top of the bow waves during passage.

Another object is to apply the CFP to mono-hull boats having widely spaced chines thereby encompassing most of the water flow into the inverted channels.

Another object is to provide a venturi flow along the sides of the boat hull thereby limiting flow-out and establishing smoother flow along the length of the boat.

Yet another object is to entrap a large volume of relative still, or slow moving water inside the deep bottom channels such that the water cannot be easily accelerated laterally by virtue of the volume of water having inherent inertia, compounded by aftward movement, thereby accomplishing pronounced lateral resistance without the need for high-drag, underwater structures.

In keeping with the same object is to force head-wave water from both bow and chines to converge and overlap upon each other thereby cushioning the impact with head seas as well as augmenting laminar flow.

A further object is to prevent cavitation by the incorporation of sharper waterlines having minimal convexity thereby reducing the rate of acceleration of head waves away from the fore section hull planes.

A further objective is to minimize fore pressure and aft suction components of resistance by the incorporation of flat buttock lines having little longitudinal rocker along the hull length.

Another object is to provide fore sections having vertical shapes becoming lateral thereby providing shapes that deflect bow and chine water flow against each other thereby inhibiting outward flow.

Yet another object is to reduce the tendency of the boat to yaw, roll, bounce or pitch pole by keeping the centers of buoyancy and lateral resistance close together.

An additional object is to provide a boat hull design that will not "sail under" at any speed above it's waterline-limit.

Another object is to apply the CFP to different boat hull types including surf boards, surf board sailors, poly-hull boats such as catamarans and tri-marans.

Another object is to apply the CFP to deep-displacement marine structures such as merchant ships, tuna boats, tankers, military craft and specially designed boats that scoop up oil and debris.

SUMMARY OF THE INVENTION

The Controlled Flow Principle (CFP) is largely dependent upon the venturi effect, which is grounded in the fact of our living in a sea of pressure equaling to over 2000 lbs. per square foot of surface area. As the flow of water speeds up, when transgressing through the venturi structure, a drop of internal, static pressure results.

The powerful potential inherent in this drop of static pressure resulting from the venturi effect, has been developed (for the first time) in the Deep Chine Boat Hull and introduces significant, structural improvements over the prior art.

The incorporation of a venturi structure, in keeping with roll-under fore section planes, results in laminar flow and the boat hull having less "skin friction" S/F resistance. The inclusion of relative flat vertical, buttock curves causes less fore and aft "pressure/suction" P/S resistance. Finely contoured entry shapes produce less "wave-making" W/M resistance. Pronounced inverted cross sections deflect water flow upon it's self suppressing turbulent TF. Deeply rockered and/or deeply descending chines develop more lateral resistance L/R and greater sea worthiness S/W.

DESCRIPTION OF THE DRAWINGS

The invention will be better understood by reference to the following drawings showing several embodiments of the invention.

FIG. 5 is a cross sectional, body view of the hull showing each of 8 stations and the depth of the channels at each station.

FIGS. 6, 7, 8, 9, & 10 are stations 1, 2, 3, 4, & 5.

FIG. 11 is a side view of another embodiment of the inventive Deep Chine boat hull design showing the chine having a very deep hook-like configuration descending below the keel.

FIG. 12 is an inverted perspective view of the design shown in FIG. 11.

FIG. 13 is a cross section body view of another embodiment showing a flat plank construction forming angular tunnels.

FIG. 14 is a cross section body view of a boat hull having convex curves along the lower side of the chines.

DYNAMICS OF FLOW

A brief review of the dynamics of flow is presented below. The APPENDIX, located in aft sections, provides more information. The following discourse is a continuation from page five.

The limit of 1.5 times the square root of the water-line-length of a boat hull is an empirically obtained approximation of the half way point between the values of 1.2 to 1.8 times the Sq. Rt., which designates the transition phase between displacement, non-planing speeds and planing speeds, for all boats. This number is apt to represent the lesser difference in speeds between two boats having equal length, weight, power source and which are experiencing the same passage conditions.

During transition speeds, which is the more vertical part of the resistant/velocity curve, the difference in speeds between two boats being compared will be less; much in the manner that a steep hill will allow a slower car to catch up with a faster car as the resistant curve increases sharply. The speed is strongly influenced by the water-line-length of the boat and it is always consequential, as the bow wave cycle transcends the length of the boat.

Velocities of the Square Root times 1.2 and times 1.8 represent the velocities wherein the bow wave approaches the stern during passage. Due to the dynamics of the flow system, forward movement causes the water to rise up above the running waterline at the bow, drop down below the displacement waterline at mid-ships, forming a lowermost trough, and rise above the running waterline at the stern. The distance from the crest of the bow wave to the crest of the stern wave cycle is determined by the speed of the boat only and not by the length. At six-kph the wave cycle is about 16 feet long; a 12-kph the wave cycle is about 24 feet long, regardless of the length of the boat in all instances. (See FIG. 17)

A square root of one, of a 16 foot water-line-length of a boat hull, emerges a number of 4 and is the equivalent of the velocity of the boat in knots per hour, or 4 kph. This is 2 kph under the beginning of the planing speeds and just before resistance rises sharply. (See FIG. 21) A Square Root times 1.8 of a 16 foot boat is about 7 kph and a Square Root times two is 8 kph. At 7 kph the stern wave is just under the transom.

At higher speeds, which is possible with planing boats, the stern wave falls behind the stern and resistance rises at a lesser rate; but with deep displacement boats exceeding the transition phase, causes the resistance curve to rise straight up, water comes over the bow deck, cavitation of flow develops under the fore sections and the boat "sails under". The boat digs a hole in the water, so to speak.

Figure 17:
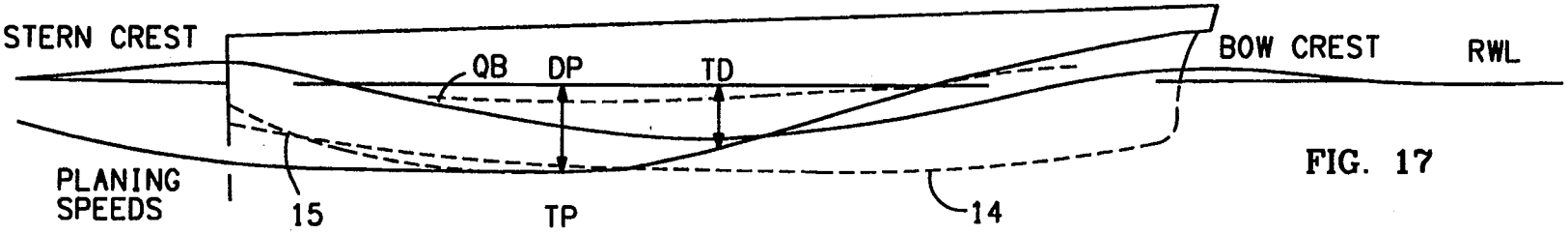
FIG. 17 is a side view of a boat in passage showing the depth of the bow wave and stern wave trough at different velocities.

However the vertical depth of the bow and stern wave cycle, or trough, is determined by the weight of the boat hull and will be at its deepest, during passage, when the crest of the bow and stern waves are at the bow and stern respectively. (FIG. 17)

The movement of water along the venturi structure causes the water to speed up, (Bernoullie's Principle) reducing the internal, static pressure along the boat bottom in general. The water speed slows down, in the aft section where the venturi structure opens up, causing the flow of water to regain it's internal static pressure thereby reducing the aft suction components along the exit of the venturi structure.

A situation develops wherein the impetus pressure increases, during passage, (resulting from the boat hull running into water), while the static pressure is reduced. The process reverses itself in the aft sections, where suction prevails (caused by the boat hull running away from water). A downward pressure occurs on the boat hull while a planing pressure forces the boat hull upwardly. But a downward pressure, introduced by the venturi structure defined through-out the channels, reduces planing and constitutes a major improvement in the art of boat design.

The Deep Chine design may have over 30% more wetted surface area per displacement than a conventional flatty design and therefore it should have more skin friction resistance per displacement, yet it has much less resistance, especially at slow-slow speeds, when wetted surface per displacement cause the greater part of resistance. At slow speeds the wave making resistance, caused by turbulent flow, is of little consequence while laminar flow still maintains minimal resistance resulting in greater difference in speeds compared with turbulent flow designs. At fast-fast speeds, the finely contoured buttock and waterlines, with pronounced concave cross section lines, limit "wave making" resistance but not as consequential as laminar flow at slow-slow speeds, limits "skin-friction" resistance, with the illustrated embodiment of the Deep Chine.

Figure 4:
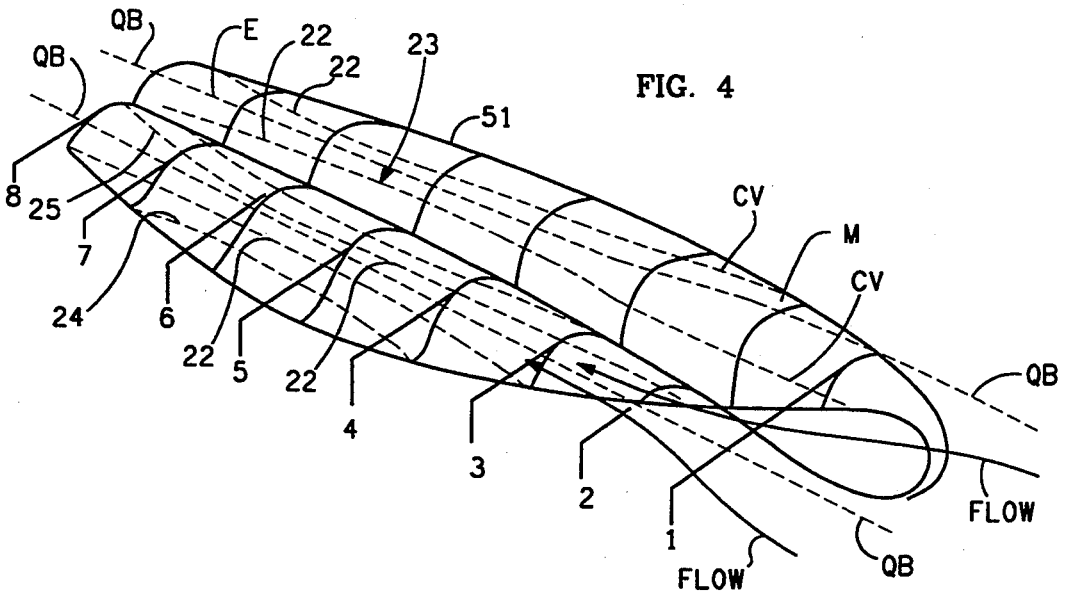
FIG. 4 is a perspective view of the "water rail" formed by the moving boat made in accordance with the inventive design.

The force of laminar flow exists acts at right angles to the surface it flows over and has only a component of opposition to the forward movement of the boat hull, as is shown in FIG. 4 Pressure/Suction illustration. As white water develops, the direction of resistance becomes increasingly more horizontal and therefore more negative to the direction of forward movement of the boat hull. Laminar flow, once it has been established, extends to the stern; unless disrupted by other forces. Laminar flow is the equivalent of a controlled flow feature.

The depth of the bow sections has little consequence on the laminar flow and the venturi effect, or the controlled flow feature. The depth of the bow may start on the underside of the board forming the point of the keel and extend aftward in a shallow, convex curve thereby forming relative shallow cross sections longitudinally through-out. On the other hand, the depth of the bow may form relative blade-like flat cross sections having variable depth which may require a stern fin to balance fore and aft lateral resistance as with a surfboard sailor. Laminar flow will still prevail as long as the flow lines are held finely contoured with pronounced inverted cross sections.

The "resistance/velocity" chart enclosed (FIG. 21) show's the square-root-of-the-water-line-length plotted on a horizontal line and resistance/power plotted on a vertical line with all values stated geometrically. A boat length of 16 feet, making passage setting, of 4 kph at a certain power setting, whereas another boat having the same weight, length, passage conditions and power setting may be going only 2 kph. The difference in passage speeds between the two boats is fifty 50 percent. At Square Root times 1.5 the difference in speeds may be 15 percent. At Square Root 2 the difference may be 30 percent and 100 percent just beyond Square Root 4. Between Square Root times 1.2 and times 1.8, difference in velocity between the two boat hulls being compared almost disappears, as illustrated by the resistance/-velocity chart.

Figure 21:
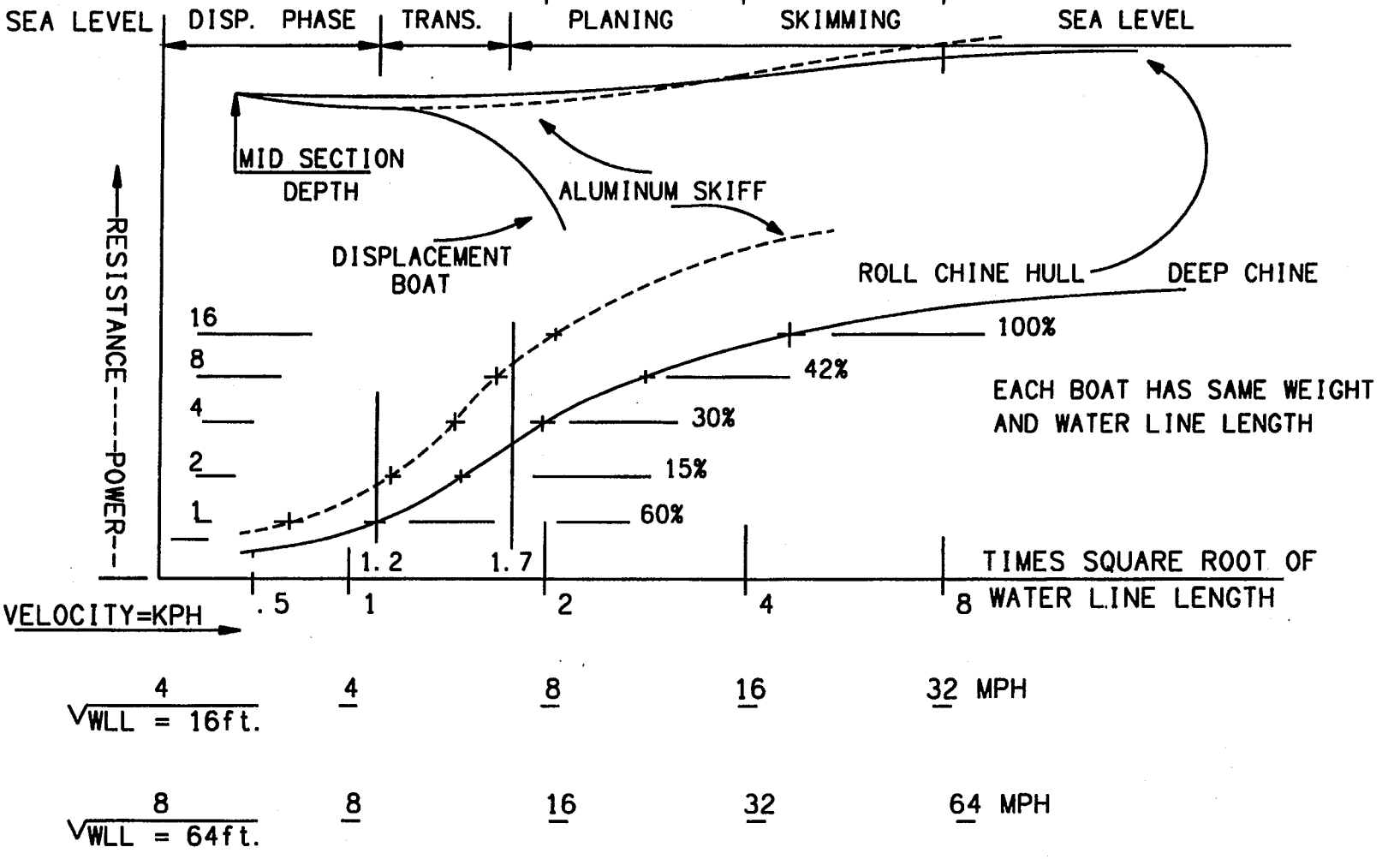
FIG. 21 is a resistance/velocity chart comparing two boats.

FIG. 21 reveals "God's Law" where comparative boat velocities are concerned and states in descriptive geometry the physical nature of the forces and events that always occur. (For an example of a resistant-/velocity curve consult Marchaj, Sailing Theory and Practice, Dodd, Mead 1964, Page 269, FIG. 162.)

The top horizontal line shows the depth of the boat hull at mid-sections. Note that the Deep Chine does not quite rise up on its bow wave at above planing speeds but remains low in the water with the bottom channels in a partially submerged, laminar flow position.

The Dynamics Of Flow reveals that the Deep Chine will tolerate even greater power per displacement than conventional boat designs because of the finely contoured buttock and water flow lines, which prevent power impact stress, and the cushioning effect made possible by the concave, cross sections which roll-under the bow and chine wave flow. Also, the deep rocker of the chines provides greater longitudinal strength.

A major accomplishment of the inventive deep chine hull is to enable a deep displacement boat to exceed it's water-line-limit, in velocity, during passage. This is made possible by the fore planes deflecting much of the head waves completely under the channels and creating a venturi effect which reduces forward planing pressures. The aft sections reduce suction forces and prevent stern squatting A venturi structure on the side of the boat accelerates water flow around the curve of the fore sections, greatly limiting wake formation, cavitation and tendency of the boat to "sail under" at speeds above planing.

DETAILED DESCRIPTION OF THE DRAWINGS

Figure 1:
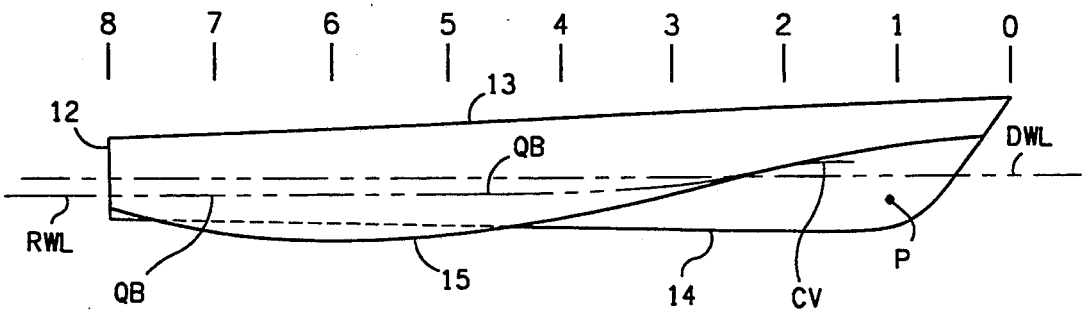
FIG. 1 is a side view of one embodiment of the inventive Deep Chine boat hull design, showing a deeply rockered chine.

FIG. 1 is a side view of one embodiment of the inventive Deep Chine Boat Hull design showing each of 8 numbered cross sections positions, 1 being at the bow point and 8 being at the stern transom. The embodiment shown has a deck 13, a keel 14 and deep chines 15 (on each side of the keel) having a relative high degree of rocker (fore and aft curvature) which drops down below the keel from station 4 through stations 5, 6 and 7, rising back up to about the resting waterline at station 8.

The fore and aft rocker along the quarter buttock QB ends at the forward waterline as it dissects the side of the boat in the prow P areas and is shown as being concave. The deeply descending chines develop less fore and aft resistance because all of the buttock entry and exit angles are shallow, and even flat, especially along the outer buttock lines.

The running waterline RWL is essentially the quarter buttock line. The deep rocker of the chines 15 is well below the quarter buttock and below half of the length of the keel and firmly embedded in the water during all surface conditions. This keeps the center of gravity of the boat low in the water.

Figure 2:
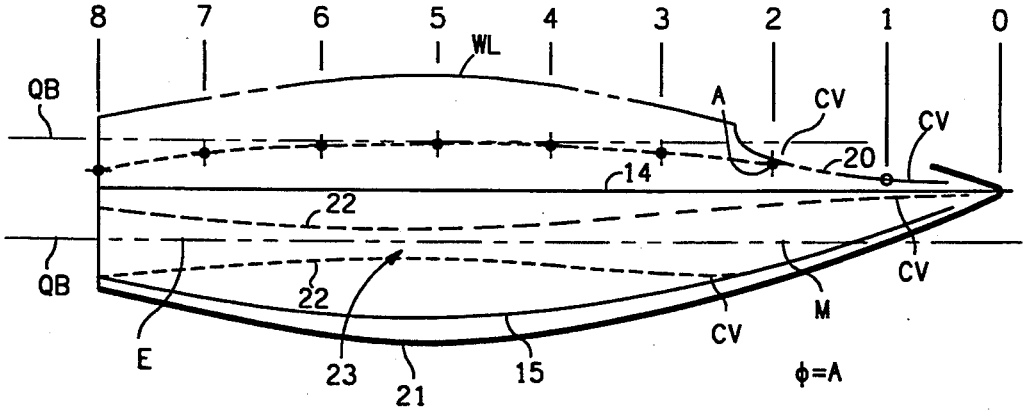
FIG. 2 is a bottom view of the same embodiment with the top half of the drawing showing the full curve of the waterline and the bottom half showing venturi structure and chine curves.

FIG. 2 is a bottom view of the inventive hull. The top half of the drawing shows the complete resting waterline, (in broken lines) which is the displacement water line DWL with the concave Cv curvature of the forward sections 20 when the boat is resting in still water. The apex A of the concave cross sections is shown between the keel and the quarter buttock as they curve toward the bow and toward the stern.

The dashed lines on either side of the quarter buttock (bottom half of the drawing) showing the venturi curvature at the displacement waterine (which is defined by waterlines at all levels) being concave Cv in the forward, mouth M parts and convex Cx in the venturi throat area 23 and exit area E. The keel 14, the gunwale 20 and the outline of the chine 15 are shown in solid lines. The quarter buttock and venturi lines are dashed.

The dashed, venturi lines 22 show that the bow and chine water flow must converge upon each other with the converging flow creating a venturi effect, the acceleration of water flow which facilitates extended laminar flow and a substantial reduction in resistance. Line 21 shows the merger with the deck and sides of the boat hull. The bow and chine entrance also initiate and create the "water rails." (See FIG. 4)

Figure 3:
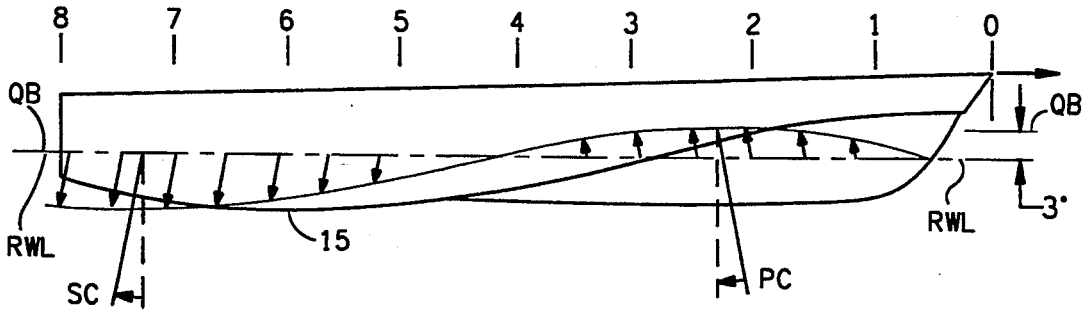
FIG. 3 is a side view of the same design showing the hull in passage illustrating the components of laminar flow.

FIG. 3 shows a side view of the Deep Chine hull in a running posture with an angle of attack being not over 3 degrees along the quarter buttock. A forward pressure P and an aft suction S longitudinal curve having aftward leaning vertical short lines indicating the degree of forward pressure or aft suction existing at a particular point on the bottom of the hull. The longer, vertical lines perpendicular to the bottom and to the quarter buttock line represent the total (laminar) force involved, which acts at right angles to the bottom planes. The shorter horizontal lines represent the component C of resistance acting directly against the forward movement of the boat. The P/S involved is much less than a conventional flat bottom boat having turbulent flow.

The foremost end of most of the buttock lines have almost 0 degree angle of attack enabling the deeply rockered chines and concave channels to overlap head-waves and deflect against themselves thereby absorbing the shock from head seas.

FIG. 4 is a perspective view of the "water rail" carved out of the surface of the water by the boat movement, during passage, the inverted bottom, being definitely concave in this embodiment. As in the case of FIG. 2, the dashed lines 22 show the venturi mouth, M the venturi throat 23 and venturi exit E and the quarter buttock QB, which curves upwardly in the upper part of the drawing but not in the lower part of the drawing. (The QB may be held flat if desired). The bow and chine flow lines illustrate how the water flow overlaps creating a spiral movement and converging flow causing the flow to accelerate aftwardly and to inhibit flow-out from the bow planes thereby reinforcing smooth, laminar flow throughout, the "water rails" thereby manifesting the controlled flow feature. Cross section lines from 1 to 8 are shown.

The general effect of the "water rail" not only provides a generally level platform for the boat hull to ride on, but it also dampens the pitching and tossing caused by head waves. It also speeds up flow, because the mid-sections, cross sections contain a greater volume of water than the fore sections which must accelerate water flow going aft and create the venturi effect, thereby causing the trapped volume of water to develop profound resistance to lateral movement because of inherent static inertia compounded by the acceleration of water against the direction of boat hull movement, with little increase in forward resistance. Laminar flow has only a component of resistance to forward movement, during passage, in comparison with a turbulent flow boat hull. See FIG. 3. (Underwater projection planes can add up to 50 percent of total resistance.)

The Deep Chine "cuts" its way through the water, yet it will come across the wind (in a sail boat) without losing speed, if the aft part of the chines are curved upward. The Deep Chine sails closer to the wind than a deep keel boat, has no under-water heeling moment and it does not need a lateral plane.

FIG. 5 shows a cross section, body view having pronounced concavity defining the bottom channels shown in separate FIGS. 6, 7, 8, 9, & 10 below for the right side. The cross section curvature is held uniform all the way to the stern 12 at stations 6, 7 and 8 shown on the left side of the drawing. This is called a monohedron run having little warpage, or twist. 50. Warpage may be acceptable in a Deep Chine boat because the flow is directed by the channels and does not depend upon gravity to maintain smooth flow. The right and left sides show the depth of concave cross sections which reveals that the volume of water contained in the concave cross sections shifts away from the keel in the forward sections and away from the quarter buttock and back toward the keel in the aftward sections. Water flow tends to "hug" the keel during passage.

The cross section stations along the bottom 50 in FIG. 5, are roughly circular but they could be, for example, elliptical or even V shaped. The important thing is; the flow is controlled by triple deflection of horizontal waterlines in conjunction with the deflection of vertical concave cross sections lines and limited deflection by buttock lines. The flow remains in contact with the surface by the triple deflection inwardly and thereby sustains laminar flow and a controlled flow feature.

The pronounced concavity of the cross sections in FIG. 5 has only minimal convexity along the lower part of the cross section curve adjacent to the chine. The structural inversion of the cross sections cause the volume of water flow to converge upon itself, during passage, as does the finely contoured waterlines and buttock lines which create no turbulent flow and do not interrupt the continuation of laminar flow.

The depth-width ratio is not critical. A depth/width ratio of 1 to 3 is quite satisfactory for the sail boat having a beam/length ratio of 1 to 3 for the embodiment shown. A depth/width ratio of 1 to 2 may be better for a catamaran and a depth/width ratio of 1 to 4 may be better for a surf board sailor. Generally, the maximum depth/width ratio is greatest in the narrow beam/length ratios. The depth of the chines relative to the bottom edge of the keel, or depth/width ratio, is also dependent upon the lateral resistance desired, side slipping requirements and deep sea worthiness needed.

The bottom of FIG. 5 illustrates the depth of the channels at each cross section station, also shown. The depth is measured by a line extending perpendicular along a line extending at right angles from the bottom edge of the keel to the bottom edge of the adjacent chine, to the apex A in the channel, as shown. Legend: o=A.

Also, by way of example, in accordance with the present embodiment of the invention, the concave waterlines may have almost 0° horizontal entrance angle at the bow and chine points of entry to water (FIG. 2) and a vertical angle of entry to water up to 90° at the quarter buttock where the keel side and chine side join together. The vertical buttock lines may have moderate rocker at the foremost beginning, or optionally concave, but in general the horizontal waterlines increase their entrance angles, going aft, while the vertical buttock curves decrease their angle to water. The overall effect is to maintain uniform flow pressure against the surface of the hull planes thereby extending laminar flow and continuation of controlled flow.

FIGS. 6, 7, 8, 9 and 10 show the stations 1, 2, 3, 4, and 5 mentioned above. The apex of each cross section is shown moving laterally around the keel and the increasing volume of the stations thereby causing the water to maintain contact with the surface.

FIGS. 11 and 12 respectively show a side view and an inverted perspective view of the inventive Deep Chine hull design, having a hook-like configuration descending below the rocker of the keel, creating a mid-section entrance shape 60 as much as half-way aft of the bow forward point of entry to water. This hook-like shape forms an aftward point of lateral resistance 61 which counter balances the forward point of lateral resistance. 60. The Center of Lateral Resistance CLR is shifted aft to balance with the Center of Lateral Effort CLE provided by a sail plan. The hook chine also helps the boat to pivot closer to the longitudinal center of gravity.

FIG. 13 shows a cross section body view of another embodiment of the inventive Deep Chine boat hull having flat plank construction, and forming angular channels extending along the inverted bottom.

FIG. 14 shows a cross section body view of another embodiment of a boat hull having convex curvature becoming broader in aft sections thereby helping said stern to rise up, during passage.

Figure 15:
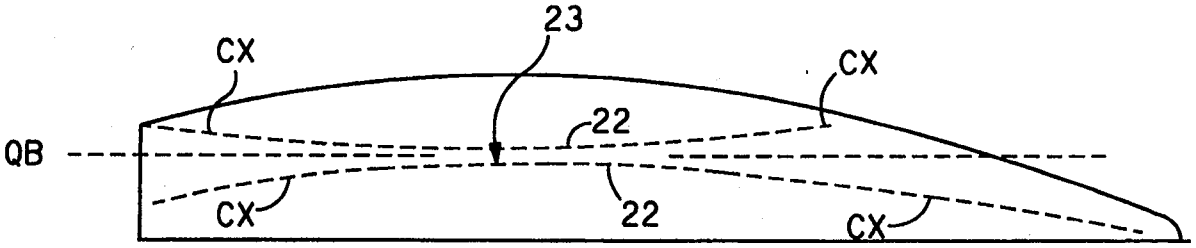
FIG. 15 is a bottom view in the upper part of the drawing showing a uniform convex venturi structure throughout.

FIG. 15 is a bottom view of the top part of the drawing showing a venturi structure having uniform, convex Cx curvature through-out the waterlines.

Figure 16:
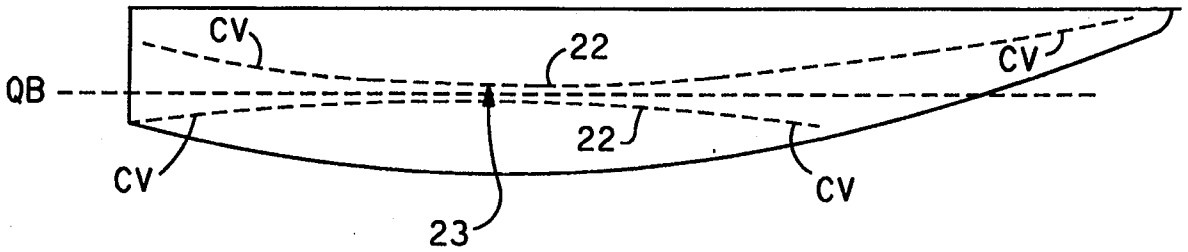
FIG. 16 is a bottom view in the lower part of the drawing showing a boat hull having concave fore sections and concave aft sections of a venturi structure. The venturi throat 23 is also show opposite the widest point WP of the drawing.

FIG. 16 is a bottom view of the lower part of the drawing showing the venturi waterlines being concave Cv in the fore sections and concave in the aft sections. A venturi throat 23 is also shown positioned directly opposite the widest point WP of the boat hull.

FIG. 17 shows a side view of the boat hull in passage illustrating the bow wave and stern wave cycle and showing the depth of the trough (TD) when the crest of the bow and stern waves are at the bow and stern respectively. At higher speeds the stern wave falls behind and the maximum depth of the trough may be aft of the stern. The chine always remains somewhat submerged in the water at any speed but the deepest point of the trough (TD) may extend forward of the venturi throat or aft of the venturi throat, depending upon the velocity of the boat, as with the lowermost transition point (TP) which is usually the deepest point (DP) of the boat hull. The alignment of these points, along with the widest point (WP) provides a natural turning point for the boat hull and preventing even casual alignment of these points weakens the Deep Chine concept.

Figure 18:
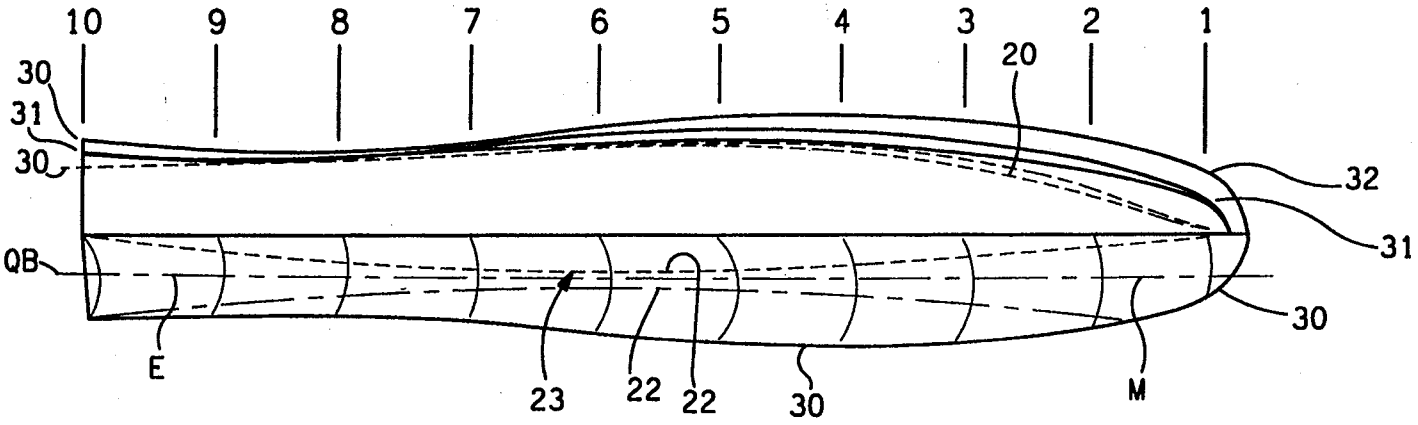
FIG. 18 is a one half bottom view of a deep displacement boat having a bottom venturi structure and side venturi structure.

FIG. 18 shows, in the upper half of the drawing, a bottom view of deep displacement boat having a side venturi structure. The outer flare-out of the upper side of the venturi structure is shown by line 30 and the lower flare-out of the venturi structure is shown by the line 31, which is the chine line. The dashed line 20 represents the side of the boat hull, at the apex of the side venturi structure extending aft along the side below the waterline. The side venturi structure is necessary to accomplish a controlled flow feature that limits wake formation along the sides. The merger between the upper inclining sides and the deck is shown in dashed line 21 and continues straight aft to station 8.

The bottom half of FIG. 18 shows a bottom venturi structure defined on both sides of the quarter buttock, both in dashed lines. Line 30 represents widest part of the boat hull with each cross section showing the concave curvature. The venturi throat is shown near station 7 at the start of the QB turn up.

Figure 19:
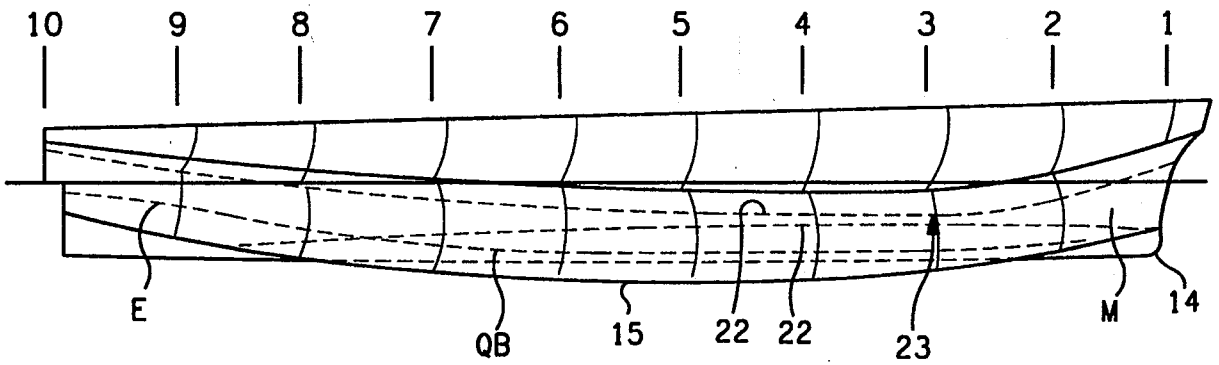
FIG. 19 is a side view of FIG. 18 showing the side of the venturi structure.

FIG. 19 is a side view of FIG. 18. Line 30 is shown dipping slightly below the waterline. The upper part of the curvature of each cross section shows the sides angling inwardly toward the deck. The lower part of the side shows the pronounced inverted curvature, especially in the fore sections, forming a channel extending continually along the side of the boat, below the waterline, with the apex of the inverted side cross sections positioned in the center of the venturi structure.

The side venturi structure accomplishes it's greatest anti flow-out effect and wake control with the throat 23 placed along the greater arch of the forward part of the waterline and well forward of the bottom venturi throat. The fore sections show the greatest flare out, or concavity from line 20, or the apex. The sides show the inward inclination angle of the upper part of boat and the inverted curves of the lower part of the boat. The venturi structure, quarter buttock and keel line are all shown in dashed lines. The mouth M and exit E is also show in FIG. 18.

Figure 20:
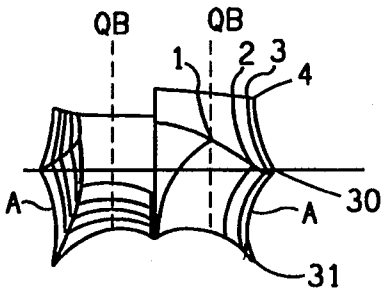
FIG. 20 is a cross section view showing the sides flaring outwardly forming an indentation at each station.

FIG. 20 is a cross section, body view showing the outward extent of the side and chine flares and the depth of the side venturi channels as being equal to the depth of the bottom venturi channels as depicted. The lateral flare-out of the side venturi structures will inhibit lateral flow-out of water from the curved sides of the boat hull, during passage, much in the manner that speeding up a car when driving around a sharp curve prevents the vehicle from rolling over, as varying flow accelerates the flow along the apex, from molecule attraction. The inclination inwardly and upardly from line 30 toward the deck is shown in the upper part of the drawing. The apex A is shown at the center of the venturi structure in dashed lines. The left side of the drawing shows the increasing flatness of the inverted side structure in aft sections. The chine 15 shows the arched rocker descending below the keel 14. Concavity is evident in all cross section lines, including buttock curves and waterlines.

FIG. 21 is a schematic version of a resistant/velocity chart showing typical resistant curves of an aluminum skiff and the (Roll Chine Hull) Deep Chine boat plotted on geometrical values along the horizontal Square Root of the water-line-length and vertical resistance/power. The upper part of the chart shows the displacement levels of both boats, being the lowest during the transition phase and rising up to sea level during planing and skimming speeds with the Deep Chine remaining below sea level. The deep Displacement boat is shown in a non-planing posture when it exceeds the transition phase. The lower part of the chart states the different speeds in knots per hour kph at progressive Square Roots, of a sixteen 16 foot boat and a sixty four 64 foot boat. The velocity values are double while the water-line-length increases four times.

Figure 22:
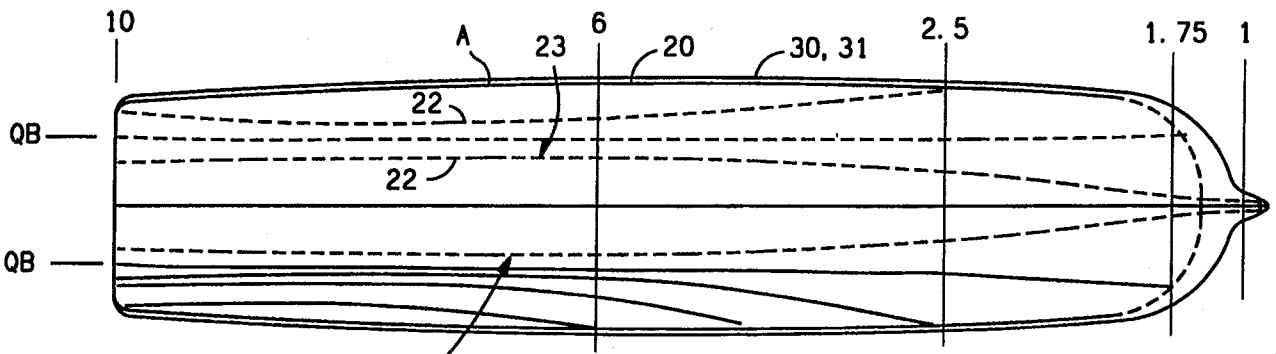
FIG. 22 is a bottom view of a surf board sailor having controlled flow features such as finely contoured waterlines buttock curves and a venturi bottom definition.

FIG. 22 shows the bottom view of a surf board sailor. The top part of the drawing shows a venturi structure 22 defined with a throat 23 and a quarter buttock in dashed lines. Numbers 30 and 31 show the lateral flare-out of the concave sides beyond line 20 and A represents the apex of the inverted sides. The lower part of the drawing shows the concave structure of the inverted bottom channels with longitudinal lines.

Figure 23:
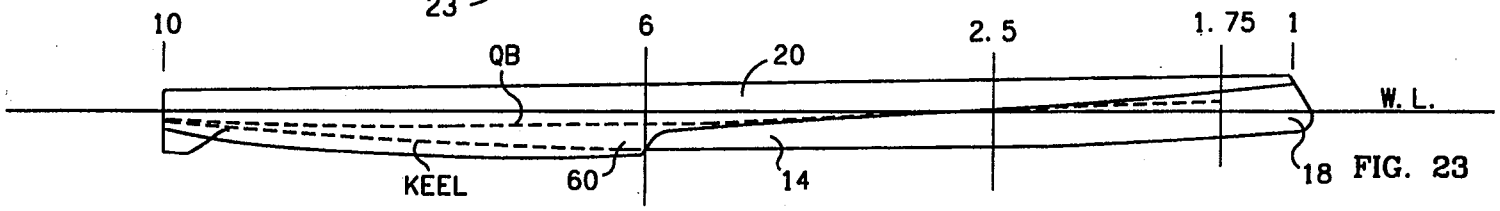
FIG. 23 is a side view if FIG. 22 having a blade bow, longitudinal keel rocker, a hooked chine descending below the depth of the keel and a stern fin.

FIG. 23 is a side view of FIG. 22 having a bow point 18 extending ahead of the rounded front end of the board, also shown in FIG. 22. The keel 14 has slight longitudinal rocker. The chine configuration 15 shows a hook at mid-ships descending below the keel, shown in a dashed lines, along with the quarter buttock. A stern fin is also shown to counter balance the bow.

Figure 24:
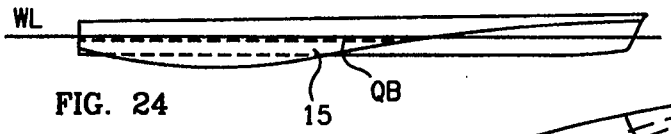
FIG. 24 is a side view of a finely contoured surf board sailor having a shallow bow and chine curves descending below the keel.

FIG. 24 shows a side view of a finely countered surf board having a shallow bow and shallow stern with a curved chine line descending below the keel with the deepest point aft of mid-ships. Lower keel lines and buttock curves are shown in dashed lines. This board is very clean, fast and has little draft. No center board or aft fin is needed.

Figure 25:
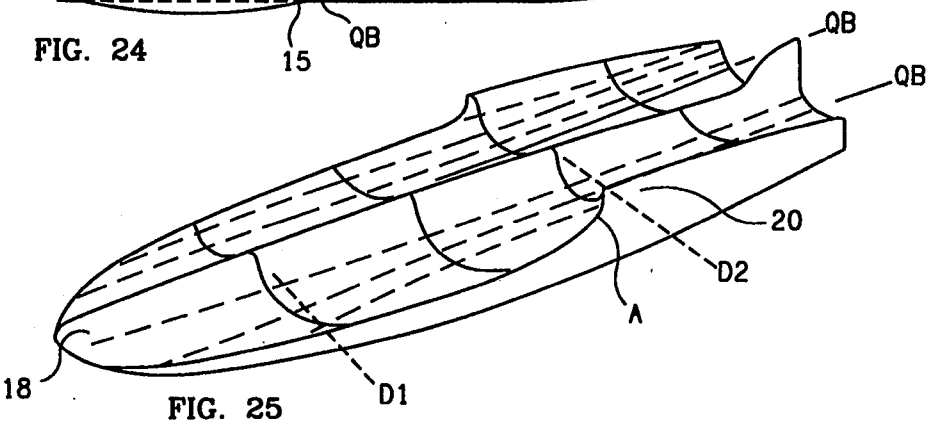
FIG. 25 shows a perspective view of FIG. 17 up-side-down showing the concave bottom structure, keel rocker, a blade bow plane with a stern fin.

FIG. 25 shows a perspective view of the up-side-down FIG. 22. The concave, inverted sides 20 are shown with the apex A. Concave cross section bottom curves are shown with dashed lines D1 and D2 revealing the depth of the bottom channels. A stern fin is also shown, which counterbalances the blade-like bow. The upper part of the drawing illustrates the concave cross section curves also depicted at four 4 station lines.

Figure 26:
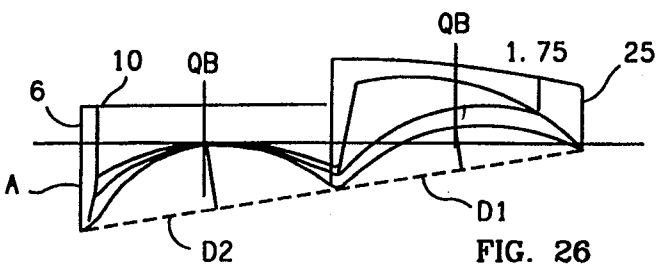
FIG. 26 shows an end, body view of a surf board sailor having a one to three ratio of a cross section depth with concave curvature across the bottom from chine to keel.

FIG. 26 is a body view of FIG. 23 and shows the concave cross sections of the sides with apex A defined below the waterline W.L., and the concave bottom cross section channels arching above dashed, cross section lines D1 and D2. The depth/width ratio is about 1 to 3 at cross section 6 and provides substantial inertia lateral resistance including vertical lateral resistance from the blade-like bow, chine hook and stern fin.

Figure 27:
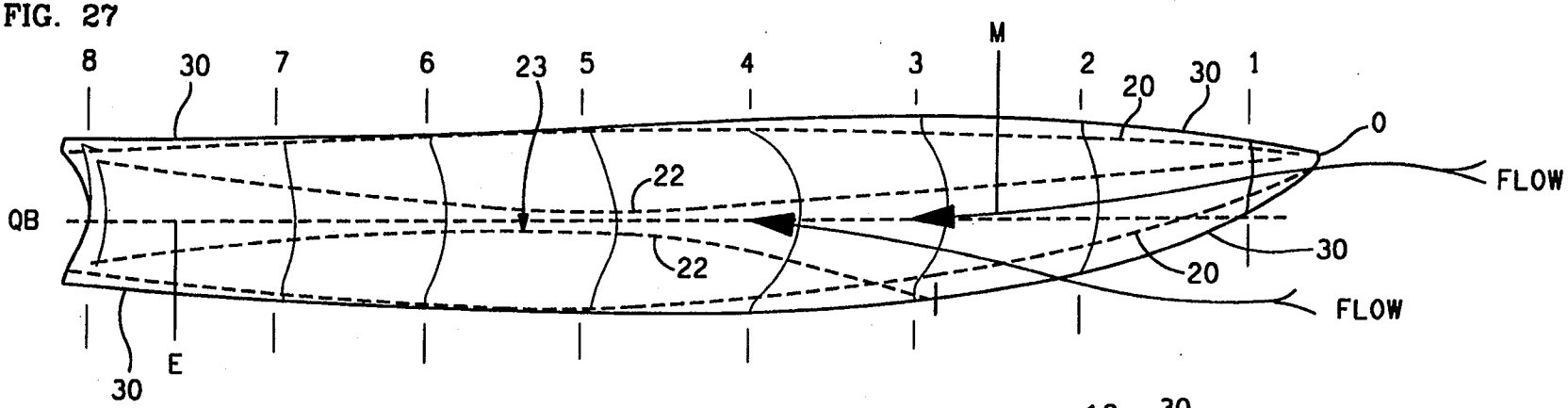
FIG. 27 is a bottom view of an asymmetrical hull.

FIG. 27 shows a bottom view of an asymmetrical hull having inverted bottom, concave cross sections defined at each of eight 8 stations. The mouth M and exit E are also shown including the venturi throat 23 positioned aft of station five 5. The venturi structure and quarter buttock QB are shown in dashed lines. Flow lines are shown deflecting water from the keel and chine toward the quarter buttock indicating how chine flow inhibits lateral deflection from the long bow sections. The lateral flare, from the apex of the side 20 of line 30 is pronounced in the fore sections, minimal at stations aft of mid-ships and flares outwardly much less at station 8. The chine line, or line 31 overlaps line 30.

Figure 28:
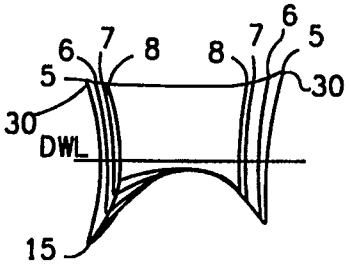
FIG. 28 shows a body view of the fore sections of an asymmetrical hull construction.
Figure 29:
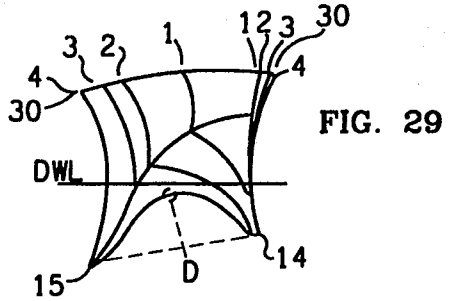
FIG. 29 is a side view of the aft the fore sections of an asymmetrical hull.

FIGS. 28 and FIG. 29 are separate body views of the fore sections and aft sections respectively. The side, inverted, concave cross section curves are pronounce in the fore sections, shallow in the aft sections and are defined at the upper level by line 30 and by line 31 at the lower level, which is the lower edge of the chine 15. The pronounced cross section concavity helps prevent turbulent wake formation. The depth/width ratio of the inverted bottom channels, as indicated by D, is about than one 1 to two 2 at the greatest in cross station 4, as shown.

Figure 30:
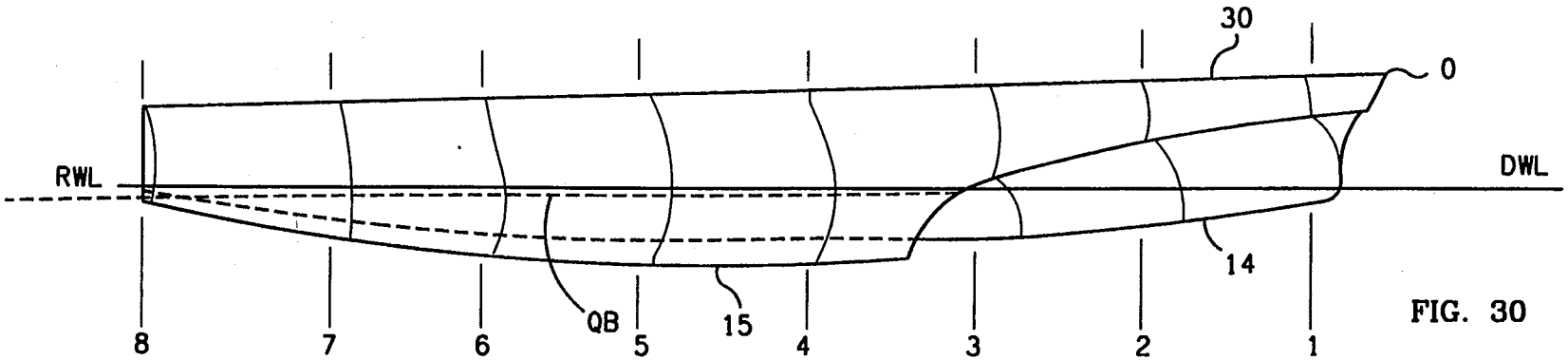
FIG. 30 is a side view of an asymmetrical hull.

FIG. 30 is a side view of FIG. 27 having concave cross sections defining inverted, concave sides. A hooked chine is depicted with the hook descending below the keel just aft of station 3, which is the widest part of the boat. (See FIG. 27) The bow and stern depth are fairly shallow, allowing for rapid turning. The keel 14 inside the chine and the quarter buttock QB lines are shown in dashed lines. The running water line RWL is the quarter buttock and is shown just below the displacement water line DWL. The asymmetrical hull has, vertical lateral resistance as evident by the blade-like bow point and chine hook and inertia lateral resistance by the pronounced depth/width ratio.

AFTER THOUGHT

The Controlled Flow Principle may be applied to any and all types of boat hull designs. It is necessary to deflect, roll-down-and-under and direct the head wave water into the finely contoured venturi structures.

The designs may be uni-lateral or have any degree of being lop-sided. The lines are held finely contoured in all longitudinal and vertical planes. Laminar flow is essential to CFP and sets forth a new dimension in boat hull design.

Any combination of old and new structures, or shapes that accomplishes a new and useful purpose is an improvement over prior art and may be claimed. The Deep Chine Boat Hull invention sets forth at least six (6) new physical relationships that accomplish a new and useful purpose.

A channeled bottom in a mono-hull boat having curved sides.

A venturi structure defined continually along the channels.

Finely contoured waterlines and buttock lines.

Roll-under fore section planes.

Fully Concave cross sections.

Deeply rockered, or deeply descending chines that may descend below the bottom of the keel and are able to accomplish deep sea worthiness; profound lateral resistance (with no under water vertical planes), without increasing forward resistance.

APPENDIX

A line is convex or concave in respect to the angle of view. A line defining a ball, looking from the outside, defines a CONVEX line. A line defining a ball looking at the inside is a CONCAVE line.

A line defining the longitudinal, horizontal planes of a boat hull is a WATERLINE.

If a line has a lesser angle of attack, or impetus to water than the preceding impetus it is a CONVEX WATERLINE.

If a line has a greater angle of attack, or impetus to water than the preceding impetus it is a CONCAVE WATERLINE.

A waterline defines a VENTURI LINE when the boat hull is at rest and not in passage, except where the bow and chine join together near the quarter buttock at the water level.

A line defining the longitudinal vertical planes of a boat is a BUTTOCK LINE.

A line defining a vertical line at right angles to the keel is a CROSS SECTION LINE.

A cross section line is convex or concave depending upon the curvature defining a CONCAVE ARCH or a rounded CONVEX SPHERE.

LAMINAR FLOW exists when the water flow is smooth and shows no white water.

SEPARATION flow exists when water flow becomes wavy and white water begins to appear.

CAVITATION of flow exists when a space appears between the surface of the hull and the surface of the water flow.

The resistance per centimeter is greater in the smooth laminar flow layer (which is the resistant gradient between the boundary layer that always stays with the boat and the non-moving outer water the overall resistance is much less when compared to the total volume of turbulent flow and wake.

A venturi structure causes water flowing through its length to cause the velocity to speed up and the internal static pressure to drop. The volume of water then becomes more resistant to lateral movement.

The convex curvature of a side venturi accelerates the movement of water passing through its converging structure, limiting the throw-out of water much in the same manner as accelerating prevents a vehicle from rolling over during a sharp turn.

A convex curve of a boat hull plane will always develop separation of flow, and/or cavitation, with the following turbulent flow or wake, at some early point along its curvature, regardless of the velocity of the hull, because the impact, or impetus, of the boat hull plane to the water soon becomes non-existent (as the flow extends aft) and the inertia imparted to the water flow, by the forward movement of the boat, has become greater than the force of gravity than is necessary to cause the water flow to remain in contact with the boat hull surface. The flow of water will always be characterized by turbulence.

A concave curve, either horizontal waterlines or vertical buttock lines, will develop no separation or cavitation of flow along its curvature, regardless of the velocity of the boat hull, because the increasing angle of attack, or impetus to the water flow that is inherent with concave planes as the water flow extends aft, imparts greater inertia to the water flow than the preceding impetus to the water flow, thereby constant contact of water to the hull surface planes will be constantly maintained. The developing flow and waves will characterized by smooth laminar flow, providing the planes develop little or no convexity prior to the converging water flow from other planes.

I claim:

1. A mono boat hull comprising:

a bow;

a stern;

a keel extending longitudinally on the underside of the hull;

a waterline;

a pair of chines disposed on each side of the keel, the chines joining a part of the bow disposed above the waterline, said chines curving outwardly from said bow at an angle to a longitudinal axis of said keel, thereafter defining a longitudinal curve extending continually aftward to said stern, said chines extending from said bow downward to a lowermost transition point on a lower edge of said chines, said chines extending aftwardly from said bow and having a chine point of entry to water at a desired point aft of said bow, a bottom surface extending laterally between the lower edge of said chines and said keel, the bottom surface having cross section planes at right angles to the longitudinal axis of said keel, the cross section planes forming inverted bottom structures bridging said chines with said keel and merging along a bottom apex, the inverted bottom structures defining longitudinal bottom channels which extend along both sides of said keel, the longitudinal bottom channels having multiple longitudinal buttock curves along said keel and said chines and a generally flat longitudinal quarter buttock curve extending along the upper level of said inverted bottom structure, the lower edge of said chines rising above water at the desired point, and extending inwardly back toward said bow thereby smoothly transforming said inverted bottom structures into vertical bow section shapes and defining a bow section of said boat hull, the vertical bow section shapes becoming increasingly vertical towards said bow of said boat, and having transverse cross section planes merging with the cross section planes from the inner side of said chines along the bottom apex, forming the upper level of said longitudinal quarter buttock curve and the foremost part of said inverted bottom structures, and continually thereafter, said inverted bottom structures having horizontal waterlines defining a bottom venturi structure along the length of said channels, the venturi structure initiating laminar flow along said inverted bottom structures.

2. The boat hull of claim 1 wherein said chines forming a deeply rockered, smoothly contoured configuration extending from said bow aftward, outwardly and downwardly to a point disposed below the bottom edge of said keel, said chines thereafter extending in said smoothly contoured configuration aftwardly, upwardly and inwardly and ending at a point approximately near said stern.

3. The boat hull of claim 2 wherein the lower edge of each chine includes, in sequence, concave, straight and convex portions, the concave portion being adjacent said bow and the convex portion being adjacent said lowermost transition point.

4. The boat hull of claim 2 wherein a smoothly contoured, lower bottom edge of said chine also includes a downward descending, hook-like configuration, the downward descending hook-like configuration having structural bulk being uniform with the inverted structures of the bottom planes of said boat hull, said downward descending hook-like configuration providing another leading edge of lateral resistance at a desired point aft of said vertical shapes of said bow section shapes in order to align a center of lateral resistance of said boat hull with a center of lateral effort of said boat hull.

5. The boat hull of claim 4 wherein said downward descending hook-like configuration of said chine extending aftward from said bow to approximately half the length of said boat hull before entering the water.

6. The boat hull of claim 4 wherein said chines extend aftwardly until the downward descending hook-like configuration enters the water at substantially the widest point laterally from said keel, whereby water flow being deflected into said bottom venturi structure by said downward descending, hook-like configuration, prior to water flow contacting said hook-like configuration, prior deflection of water flow thereby inhibiting outward water flow from long bow transverse cross section planes well forward of said downward descending hook-like configuration entering the water.

7. The boat hull of claim 2 wherein the structure of said chine having increasing lateral thickness and extending aft of a point on said lower edge of said chine along said horizontal waterlines, said thickness being greatest at said mid-sections of said horizontal waterlines and decreasing to a point on the aft bottom edge of said chine, said horizontal waterlines being varyingly concave to convex in said foremost part of the inside of said chine, convex in said mid-sections and varyingly convex to concave in said aft part, said thickness structure having uniformity with said inverted structures of said longitudinal bottom channels, said varying thickness forming the chine side of a venturi curvature.

8. The boat hull of claim 1 wherein said lowermost transition point of said chines is disposed below the depth of the trough created by the flow of water between the crest of the bow and the crest of the stern wave, at all velocities.

9. The boat hull of claim 1 wherein the lower edges of said chines and a bottom edge of said keel define transverse cross section planes which are disposed perpendicularly to the longitudinal axis of said keel forming longitudinal bottom channels having a varying depth as measured from said bottom apex of the longitudinal bottom channels perpendicularly to said transverse cross section planes lines in planes defined by said cross section planes, said varying depth continually decreasing aft and forward from a predetermined point.

10. The boat hull of claim 9 wherein said predetermined point is located longitudinally at a distance from said lowermost transition point that is less than ninety (90) per cent of the water line length of said boat hull.

11. The boat hull of claim 9 wherein said predetermined point is longitudinally located a distant from the center of a throat of each venturi structure that is less than ninety (90) percent of the water line length of said boat hull.

12. The boat hull of claim 9 wherein said predetermined point is longitudinally located at a distance from a point where said boat hull has maximum width that is less than ninety (90) percent of the water line length of said boat hull.

13. The boat hull of claim 1 wherein said boat hull being a mono-hull design having the sides attached to the upper portion of said vertical bow section shapes on both sides of said keel, said sides curving laterally from said bow at an angle to the longitudinal axis of said keel, becoming deeper, going aft, descending below the horizontal waterline and having said desired point of entry to water, said sides becoming parallel with said keel and defining the widest part of said boat hull, thereafter said sides curving inwardly back toward said keel and defining the aft curve of said boat sides, said boat hull having said longitudinal bottom channels extended along a longitudinal quarter buttock curve of said inverted bottom structures.

14. The boat of hull claim 1 wherein said longitudinal bottom channels have initiated laminar flow along said inverted bottom structures, during passage, by said vertical bow sections shapes deflecting water flow upwardly and outwardly from the bottom edge of keel planes, merging with water flow being deflected upwardly and inwardly from the lower edge of chine planes, whereby a foremost part of head-wave water flow is deflected completely under said bottom channels and overlapping along said longitudinal buttock curves, and along said venturi structure, during passage, whereby the laminar flow is also extended in a smoothly flowing manner and constitutes a controlled flow feature.

15. The boat hull of claim 14 wherein said cross section planes of said vertical bow sections shapes having deflected the head-waves completely under said longitudinal bottom channels, during passage, thereby creating smooth water-rails from the surface of the sea, the water-rails providing a generally level platform for said boat hull to ride on and constitute a controlled flow feature.

16. The boat hull of claim 15 wherein said longitudinal bottom channels provide pronounced lateral resistance by encompassing a comparative large volume of relative still water, in respect to lateral movement, defined by said smooth water-rails and formed by said longitudinal bottom channels, the volume having mass and inherent static inertia, which cannot be accelerated laterally easily, during passage, by virtue of said longitudinal bottom channels having said horizontal waterlines which converge in the forward part of said boat hull, causing the comparative large volume of relative still water to accelerate in an aft direction, the aft direction of water movement acting as a buffer against lateral movement of said boat hull going forward in an opposite direction, thereby providing profound lateral resistance that is far greater than other lateral resistance means, the profound lateral resistance means compounded by said acceleration also has less restriction to forward movement than other lateral resistance means because the water flow is laminar flow having only a component of resistance to forward passage as compared to turbulent flow force, which all conventional boats have.

17. The boat hull of claim 16 wherein said boat hull having the means to maintain a side slip ratio of four (4) degrees, or less, in the distance said boat hull travels its water-line-length, at a velocity in kph equal to the Square Root of the water-line-length of said boat hull.

18. The boat hull of claim 14 wherein said vertical bow sections shapes deflect head-waves encountered during passage into said inverted longitudinal bottom structures thereby causing bow and chine head waves, including surface seas to roll laterally and downwardly and into said inverted bottom structures and deflect against themselves thereby cushioning inverted bottom surfaces from damaging impact with surface seas.

19. The boat hull of claim 1 wherein said longitudinal bottom channels having concave cross sections defining tube-like channels transcending the longitudinal length of the boat hull, said longitudinal bottom channels also having regions of convex curvature along the inner, lower part of said chine and along the lower parts across said keel.

20. The boat hull of claim 1 wherein said boat hull's longitudinal bottom channels have cross sections formed by generally flat cross sections, the flat cross sections forming angular channels extending along said boat hull bottom, the angular channels having concave curvature along said bottom apex of said channels.

21. The boat hull of claim 1 wherein said boat hulls longitudinal bottom channels have cross sections being highly concave along the longitudinal quarter buttock curves and highly convex along said inner side of said lower chines, the aft sections becoming broader going aft along the convex part thereby helping said stern to rise up during passage.

22. The boat hull of claim 1 wherein said bottom apex of said cross sections are initially positioned close to said keel in the fore sections, positioned along said longitudinal quarter buttock curve in the mid-sections, and shifting toward said keel there-after, thereby water volume being directed around said keel during passage.

23. The boat hull of claim 1 wherein the upper level of said inverted bottom structure along said longitudinal quarter buttock curves are generally level with a point laterally opposite where said chines enters water.

24. The boat hull of claim 1 wherein the upper level of said inverted bottom structure along said longitudinal buttock curves are generally flat in aft sections of said boat hull and having flat to less than a five (5) degree turn up angle, or having minor convex rocker, in fore sections.

25. The boat hull of claim 1 further comprising said inverted bottom structure along said longitudinal buttock curves adjacent to said keel have greater rocker in fore sections of said boat hull than said longitudinal buttock curves outwardly therefrom.

26. The boat hull of claim 25 wherein a foremost part of said inverted bottom structure along said longitudinal buttock curves has concave curvature.

27. The boat hull of claim 26 wherein fore planes of concave cross sections are deliberately held finely contoured to the extent necessary to prevent water flow from deflecting outwardly and separating from the concave fore planes before the converging effect from said horizontal waterlines in the venturi mouth structure prevents said separation.

28. The boat hull of claim 1 wherein said longitudinal bottom channels and said horizontal waterlines extends aft from said bow, or bow point, which together with said chine point of entry to water define the beginning of the bottom venturi structure which extends continually along the entire length of said longitudinal bottom channels, said bow and said chine points of entry starting a venturi mouth in said longitudinal bottom channels, said horizontal waterlines converging laterally, going aft, toward said longitudinal quarter buttock, thereafter said horizontal waterlines forming a venturi throat in each channel, the venturi throat being positioned longitudinally at a desired point along said longitudinal bottom channels, said horizontal waterlines thereafter expanding laterally, toward said stern, thereby forming a venturi exit, said venturi bottom structure providing a controlled flow feature.

29. The boat hull of claim 28 wherein said bottom venturi structure is defined throughout a varying depth of said longitudinal bottom channels along said horizontal waterlines, said venturi structure being more pronounced at a deepest point of said longitudinal bottom channels and generally upward from said lowermost transition point of said chines.

30. The boat hull of claim 29 wherein foremost sections of said horizontal waterlines have less than a twenty (20) degree maximum angle of deviation from the longitudinal axis of said longitudinal quarter buttock to a bow point entry to water and from said longitudinal quarter buttock to said chine point of entry to water.

31. The boat hull of claim 28 wherein said horizontal waterlines having finely contoured, convex, uniform curvature along said keel and along the inner side of said chines, through out the length of said longitudinal bottom channels, said horizontal waterlines defining said bottom venturi structure in said longitudinal bottom channels.

32. The boat hull of claim 28 wherein a concave set of smooth horizontal waterlines transforms into a convex part, the transition occurring at a point approximately longitudinal to said chine point of entry to water.

33. The boat hull of claim 1 wherein said longitudinal bottom channels define said horizontal waterlines along said keel and said chines, said horizontal waterlines being generally concave in their foremost part and generally convex in their mid-sections and aft sections parts and becoming generally concave in their stern parts.

34. The boat hull of claim 1 wherein said horizontal waterlines, said longitudinal buttock curves and said transverse cross section planes being generally uniform throughout said longitudinal bottom channels but said horizontal waterlines and said longitudinal buttock curves including said transverse cross section lines will become abrupt in aftward sections if needed to accomplish a controlled flow feature.

35. The boat hull of claim 1 wherein forward parts of said horizontal waterlines, the forward part of said longitudinal buttock curves and transverse cross section planes having concave curvature, whereby said boat hull having triple concavity contained in forward parts of horizontal waterlines, forward part of longitudinal buttock curves and in the transverse cross section planes of said boat hull.

36. The boat hull of claim 1 wherein said venturi structure has converging lines extending aft from bow and chines points of entry to water, said converging lines causing the water flow to accelerate, during passage, in an aft direction thereby decreasing the internal static pressure of said water flow, said internal static pressure of reduction negating the increasing impetus pressure caused by the forward movement of said boat hull against the water flow, said water flow slowing down in sections aft of said venturi throat area allowing the water flow to regain its internal static pressure and reduce aft suction caused by said boat running away from water, whereby said venturi structure facilitating the pressure/suction forces enabling the boat hull to maintain a level running posture.

37. The boat hull of claim 1 wherein said horizontal waterlines extending aft from bow and chine points of entry to water converge laterally toward said longitudinal quarter buttock curve, said horizontal waterlines increasing their impetus to water, whereas said longitudinal buttock curves decreasing their impetus to water, going aft, the combined curvatures increasing their impetus to water to compensate for the forward movement of water flow caused by viscosity drag, the increasing impetus thereby causing water flow to maintain uniform pressure flow along the transverse cross section planes of fore sections and accomplishing a controlled flow feature, thereby preventing separation of water flow from surface planes and sustaining said laminar flow, said laminar flow accelerating in an aft direction when transgressing through said bottom venturi structure resulting in a drop of internal static pressure along said inverted bottom structures derived directly from the converging effect of the increasing combined impetus of said longitudinal buttock curve impetus and said horizontal waterline impetus.

38. The boat hull of claim 37 wherein accelerating laminar flow extending aftward along said inverted bottom structure, creates a force acting at right angles to the surface it flows over.

39. The boat hull of claim 1 wherein said boat hull having initially stronger construction with deeply rockered chine configuration offering greater longitudinal structural strength and having finely contoured buttock curves and waterlines that limit damaging impact with surface seas, said boat hull design thereby being more able to accept greater accommodation of power than contemporary boats.

40. The boat hull of claim 39 wherein said laminar flow having a perpendicular force acting at a general angle that is at right angles to the surface it flows over and not at an angle directly opposed to the directing of forward movement of said boat hull, said laminar force representing a summation of the forward pressure force and the aft suction force extending along said inverted bottom structure during passage wherein the difference between the perpendicular, laminar flow force and turbulent flow force, which acts directly opposite the direction of said longitudinal movement of said boat hull, thereby said laminar flow force having only a fraction of turbulent flow force acting directly opposite the direction of said longitudinal movement of said boat hull.

41. The boat hull of claim 1 wherein said boat hull is a surf board sailor having a board-like structure with longitudinal rocker along said bottom surface, said surf board sailor may have any combination of length, width and depth ratio desired, said surf board sailor having a bow point projecting ahead of the horizontal, lateral bow curve and merging with the under part of said inverted bottom structures thereby representing the beginning of said keel, said keel becomes deeper as it extends aftward to said mid-sections thereafter rising upwardly to a stern, where a stern fin is positioned that imparts vertical lateral resistance that is proportional in respect to the vertical lateral resistance of said bow point, said bow point having blade-like fore sections thereby causing early deflection of said head waves along said horizontal waterlines which converge said head waves, in the forward part of the boat, along said longitudinal bottom channels, two chines are positioned laterally on each side of said keel having a point of entry to water at a predetermined point aft of said bow point, said chines extend straight aft and having a hook-like curvature which extends blow said waterline approximately adjacent to said mid-sections, said buttock curves are generally flat throughout.

42. The boat hull of claim 41 wherein said surf board sailor having clean, smooth longitudinal lines through out said length, said bow point being very shallow in depth and forming at said bottom surface and becoming said keel there-after, said keel becomes deeper going aft and separates said longitudinal inverted bottom channels extending continually aftward from said bow to said stern which defines said venturi bottom structure, said chines forming lateral at a distance to said bow point having a continuous, generally straight, longitudinal side curve extending aftward from said bow section, said chine bottom edge being concave in said fore sections, becoming straight and descending downward becoming convex in said mid-sections, descending below the lowest part of said keel, thereafter curving upward toward said stern, said transverse cross sections extending laterally having a depth/width ratio of one to three across a deepest point of said chines, said longitudinal buttock curves having generally flat longitudinal curvature in said aft sections and curving slightly upward in said fore sections.

43. The boat hull of claim 41 wherein said surf board sailor having side venturi structure with minimal area and said venturi bottom structure with finely contoured, converging flow lines in the fore sections that accomplish said acceleration of water flow aftward during passage, thereby compounding said inertia lateral resistance and rendering the inertia lateral resistance profound, said aft direction of water movement along said longitudinal bottom channels being laminar flow thereby incurring less increase in resistance to the forward movement during passage, than other lateral resistance means hereby introducing very fast surf board sailor designs.

44. The boat hull of 41 wherein said keel having relative moderate depth in said fore sections but said bow sections creating a degree of forward vertical lateral resistance, said chine hook being contoured to achieve said aftward point of said vertical lateral resistance to establish a more balanced and broader area of vertical lateral resistance along said hull length, said asymmetrical hull design having balanced vertical lateral resistance combined with high inertia lateral resistance, enabling said boat hull to maintain minimal side slip with little increase in resistance to forward movement, thereby said design being very fast and arriving close to a point indicated by the longitudinal direction, said design will not hook at any speed or prevailing passage conditions, said boat hull having no difficulty coming across the wind with the shallow bow and stern sections.

45. The boat hull of claim 1 wherein said longitudinal keel of said boat hull is positioned laterally to port or to starboard of a central longitudinal underside, thereby forming an asymmetrical hull.

46. The boat hull of claim 45 wherein the asymmetrical hull having concave, longitudinal bottom channels with a depth/width ratio about one to two across the chine and keel at mid-ships, said sides having inverted, concave curvature forming longitudinal, inverted side channels on the outer side of both sides through out the length of said boat hull, with said side venturi structure defined therein, the concavity being more pronounced along the fore sections of the chine side and the flat keel side, said longitudinal bottom channels converging water flow under said asymmetrical boat hull which define said venturi bottom structure through out the length of said longitudinal bottom channels as well as converging water flow along said side longitudinal channels, during passage, concavity is universally maintained in all cross sections along said length of said boat hull, which helps to prevent wake formation, a chine hook entering the water at about the widest point of said asymmetrical boat hull, thereby having very little initial tendency to cause turbulent flow along said sides.

47. The boat hull of claim 1 wherein said varying depth of said longitudinal bottom channels have a general depth/width ratio of one part deep to three parts wide for each of said longitudinal bottom channels at the deepest of said cross section planes, the depth/width ratio being subject to desired changes respecting lateral resistance, side slipping requirements and deep sea worthiness that may be needed.

48. A Deep Displacement Boat Comprising:

a bow;

a stern;

a keel extending longitudinally on the under side of the hull;

a waterline;

a pair of chines disposed on each side of the keel defining a bottom edge of the sides of a deep displacement boat hull, the sides joining the greater part of the bow disposed above and below the waterline, said sides, curving outwardly from a bow point, going aft, at an angle to the longitudinal axis of said keel, thereafter extending in a generally straight plane parallel to said keel and terminating adjacent to the stern, the chines extend aftward along the bottom edge of said sides with the lower edge forming a rocker which descends aft from just above the bottom of said keel at the bow point and downward to a lowermost transition point, thereafter rising upward, a bottom surface extends laterally between the lower edge of said chines and the lower edge of said keel, said bottom surface having inverted transverse cross section planes at right angles to the longitudinal axis of said keel, the inverted transverse cross section planes forming inverted bottom structures bridging said chines with said keel, the inverted bottom structures defining longitudinal bottom channels which extend along both sides of said keel, the longitudinal bottom channels having longitudinal quarter buttock curves, extending straight aftward, defining an upper level of said longitudinal bottom channels, along a bottom apex curve defined therein and rising upward in aft sections to just below the stern, bow sections having vertical cross section planes defining said bow point entry to water with the vertical cross section planes curving laterally around the fore sections, going aft, and forming the deep displacement sides, said inverted bottom transverse cross section planes, adjacent to said keel, merging with said inverted bottom transverse cross section planes, adjacent to said chines along the bottom apex defined on the upper level of said longitudinal bottom channels, said longitudinal bottom channels having horizontal waterlines defining a venturi bottom structure along the length of said longitudinal bottom channels, said venturi structure having the horizontal waterlines converging in the forward part of said boat hull.

49. The boat hull of claim 48 wherein the deep displacement sides flaring outwardly from a approximate vertical center of said boat hull, being widest in the forward mid-ships, becoming less wide thereafter but becoming wider at said stern to a lesser degree than forward, said vertical cross section planes inclining inwardly and downwardly from the approximate vertical center, of said boat hull, and upwardly and inwardly from the lower edge of said chines, and merging along a side apex curves defined therein, forming inverted side channels in the lower half of said sides, the inverted side channels, in keeping with the widest part, being deepest in the fore sections, becoming less deep in mid-sections and then becoming deeper in said stern sections, the inverted side channels having said horizontal waterlines, which converge in the forward sections, defining a side venturi structure along the longitudinal length of said inverted sides of said boat hull, the side venturi structure joining the bottom venturi structure along the lowermost level of said chine.

50. The boat hull of claim 49 wherein said inverted side channels modified by said approximate vertical center rising upwardly in said fore sections and in the aft sections, said upper part of said sides angling inwardly toward a gunwale, or the lateral edge of a the deck.

51. The boat of claim 49 wherein said boat hull having said longitudinal inverted side channels in the approximate lower half of said sides, extending longitudinally along said deep displacement boat hull sides, the depth of said longitudinal inverted side channels decreasing forward and aftward of a predetermined deepest point along said sides, whereby the water flow around the longer longitudinal length of the upper and lower dimensions of said longitudinal inverted side channels is longer than water flow around said side apex curves defined therein, which are shorter in total longitudinal length, the longer longitudinal length of the upper and lower dimensions causing a greater acceleration of water flow around said upper and lower levels than water flow around said side apex curves thereby creating a force, from molecular attraction, which causes a continual change in direction of water flow along said side apex curves and in a direction toward the longitudinal axis of the boat hull, during passage, thereby inhibiting said water flow from deflecting outward from said side apex curves, reducing separation, turbulent flow including wake and facilitating a controlled, laminar flow effect therein.

52. The boat hull of claim 51 wherein said longitudinal inverted side channels have cross section planes which cause the upper and lower part of the planes to deflect water flow inwardly toward said side apex curves defined therein, thereby said deep displacement boat hull having structural means that continually compress said water flow inwardly toward said side apex curves and reduce lateral throw-out separation and turbulent flow, during passage.

53. The boat hull of claim 49 wherein said bottom venturi structure has a widest point across the lateral dimension of said venturi structures that is predetermined located longitudinally at a distance that is within ninety (90) percent of the water-line-length of said boat hull.

54. The boat hull of claim 49 wherein said deep displacement boat is able to exceed in velocity its inherent water-line-length limitation by virtue of said bottom venturi structures reducing planing pressure in the fore sections and reducing stern suction in the aft sections thereby preventing the development of excessive increase in forward resistance, during passage, said side venturi structure eliminating cavitation along said sides, thereby preventing sailing under, said deep displacement boat hereby rendering the boat able to exceed it's inherent water-line-limit in velocity.

55. The boat hull of claim 49 wherein the surface area of said inverted side channels have a surface area that is equal to or greater than the surface area of said longitudinal bottom channels of said deep displacement boat.

56. The boat hull of claim 55 wherein said laminar flow having said perpendicular force with much less resistance to forward movement than said turbulent force, the lesser resistance becoming increasingly consequential as said velocity of said boat hull drops below the velocities of a transition phase, which is between planing and non planing velocities wherein velocity increases at a more rapid rate, thereby said boat having said laminar flow force effectively compensating for said turbulent force in spite of said turbulent force having almost a third less surface area per displacement.

57. The boat hull of claim 55 wherein controlled flow features include the incorporation of said venturi structure, said venturi structure having converging, roll-under fore sections creating the water-rails thereby providing less wave-making resistance to forward movement, during passage, than said turbulent flow boat hull, the lesser wave-making resistance becoming increasingly consequential to reduction of resistance in forward movement and more obvious as said velocity of said boat hulls increases beyond the transition phase velocities as revealed by resistant/velocity comparison curves.

58. The boat hull of 55 wherein the difference in resistance to forward movement of said boat hull having controlled, laminar flow acting at right angles to the direction of forward movement of said boat hull in comparison with a boat hull having turbulent force acting directly opposite the direction of forward movement, becoming the least at a velocity of 1.5 times the Square Root of said water-line-length in kph of said boat, or half way through said transition phase, the difference in resistance becoming greater at higher and lower at velocities above or below said 1.5 times the Square Root of said water-line-length, said laminar flow with controlled flow features always having less resistance to forward movement than said turbulent flow force at any velocity, wherein said boat hulls having equal water-line-length, displacement, power setting and passage conditions during all resistance/velocity testing.

59. The boat hull of claim 49 wherein said side venturi structures have a widest point across the lateral dimension of said venturi structures that is predetermined located longitudinally at a distance that is within ninety (90) percent of the water-line-length of said boat hull.

60. The boat hull of claim 48 wherein said lowermost transition point of said chines descends below a lowermost bottom level of said keel.

61. The boat hull of claim 48 wherein said longitudinal bottom channels have a varying depth as measured from the bottom apex curve in said longitudinal bottom channels disposed perpendicularly to a line at right angles transgressing between said keel and said chines, said varying depths continually increasing forward and aftward from a predetermined point located along said lowermost transition point for said bottom venturi structure.

62. The boat hull of claim 48 wherein a deepest point of said bottom lowermost transition point of said chine is located at a distance that is less than ninety (90) percent of the longitudinal water-line-length of said hull.

63. A boat hull design having at least three water entry points, comprising:

(a) a keel;

(b) deeply rockered chines flanking and joined to the keel, forming with the keel deeply rockered cross-section bottom channels extending longitudinally along each side of said keel and forming the bottom of said hull, (1) the cross sections of said bottom channels having bow sections being slightly concave, (2) said cross section bottom channels having remaining sections being deeply concave, the channels being deepest aft of the mid-sections of the hull at a deepest point of said chine, (3) the channels having essentially flat buttock lines, in said aft sections and minimal convexity along all fore section waterlines, (4) the chines beginning at approximately the bow of the hull, curving below the waterline of the hull at approximately one third the length of the hull from the bow, and extending deeper than the keel until curving up to the waterline of the hull at approximately the stern, (5) the channels being widest at about the deepest point of the chines, at which point the channel is at least about one-third as deep of the distance from each chine to the keel, (c) wherein the purpose of the concave cross-section channels is to roll a bow wave down and completely under the hull and into said channels, said channels continually entrapping a mass of relative still water constantly created out of bow and surface waves encountered during passage to form water rails for the boat hull to ride on and to hold the boat on course during all sea and weather conditions or speed of passage, whereby:

(1) the hull has minimal wave-making resistance to forward passage in all sea surface conditions, (2) the hull has substantial lateral resistance and resistance to skidding with minimal increase in forward resistance by reason of concave channels entrapping a relative large mass of relative still water which cannot be accelerated laterally easily due to its inherent inertia, (3) the hull has suppressed development of turbulent flow and the spread of wake, (4) the hull maintains constant hull pressure against the water flow, thereby greatly extending laminar flow, (5) the hull has an effective low center of gravity thereby lessening the effect of lateral forces to cause the hull yaw, broach or pitch, (6) the concavity of the channels provides an overall cushioning effect and protection of the hull from shock, slamming, and pounding from turbulent seas, and (7) the deeply rockered deep chines keep much of the boat hull deep in the water, accomplishing deep displacement seaworthiness and high speed performance in all weather conditions.

* * * * *